US009728301B2

(12) United States Patent
Ikeda et al.

(10) Patent No.: US 9,728,301 B2
(45) Date of Patent: Aug. 8, 2017

(54) INSULATED WIRE AND ELECTRIC OR ELECTRONIC EQUIPMENT

(71) Applicants: FURUKAWA ELECTRIC CO., LTD., Tokyo (JP); FURUKAWA MAGNET WIRE CO., LTD., Tokyo (JP)

(72) Inventors: Keisuke Ikeda, Tokyo (JP); Hideo Fukuda, Tokyo (JP); Daisuke Muto, Tokyo (JP); Keiichi Tomizawa, Tokyo (JP)

(73) Assignees: FURUKAWA ELECTRIC CO., LTD., Tokyo (JP); FURUKAWA MAGNET WIRE CO., LTD., Tokyo (JP)

( * ) Notice: Subject to any disclaimer, the term of this patent is extended or adjusted under 35 U.S.C. 154(b) by 0 days.

(21) Appl. No.: 14/688,548

(22) Filed: Apr. 16, 2015

(65) Prior Publication Data

US 2015/0235736 A1 Aug. 20, 2015

Related U.S. Application Data

(63) Continuation of application No. PCT/JP2013/080866, filed on Nov. 15, 2013.

(30) Foreign Application Priority Data

Nov. 30, 2012 (JP) ..... 2012-263748

(51) Int. Cl.
*H01B 7/00* (2006.01)
*H01B 7/29* (2006.01)
(Continued)

(52) U.S. Cl.
CPC ..... *H01B 7/292* (2013.01); *H01B 3/305* (2013.01); *H01B 3/308* (2013.01); *H01B 3/427* (2013.01); *H01F 27/323* (2013.01)

(58) Field of Classification Search
CPC ..... H01B 7/0208
(Continued)

(56) References Cited

U.S. PATENT DOCUMENTS 4,675,474 A 6/1987 Neuroth
5,358,786 A * 10/1994 Ishikawa ..... H01B 3/30 174/110 AR
(Continued)

FOREIGN PATENT DOCUMENTS

CA 1161616 * 2/1984
CN 1906706 A 1/2007
(Continued)

OTHER PUBLICATIONS

Chinese Office Action and Search Report, issued Dec. 25, 2015, for Chinese Application No. 201380015324.6, along with English translations.
(Continued)

*Primary Examiner* — Chau N Nguyen
(74) *Attorney, Agent, or Firm* — Birch, Stewart, Kolasch & Birch, LLP

(57) ABSTRACT

An insulated wire having a conductor, and a multilayer insulating layer composed of two or more layers coating the conductor, wherein the innermost insulating layer of the multilayer insulating layer is an insulating layer formed of a crystalline thermoplastic resin having a storage elastic modulus of 10 MPa or more at 300° C. and outer insulating layer(s) other than the innermost insulating layer include(s) an insulating layer formed of a crystalline thermoplastic resin having a melting point of 260° C. or higher and a storage elastic modulus of 1,000 MPa or more at 25° C., and adjacent insulating layers have a relationship such that the storage elastic modulus at 25° C. of the thermoplastic resin of the outer insulating layer is equal to or smaller than the
(Continued)

inner insulating layer; and electric/electronic equipment formed using the insulated wire as a winding and/or lead wire of a transformer that is incorporated into the electric/electronic equipment.

7 Claims, 2 Drawing Sheets

(51) Int. Cl.
*H01B 3/30* (2006.01)
*H01B 3/42* (2006.01)
*H01F 27/32* (2006.01)

(58) Field of Classification Search
USPC ..... 174/120 R, 120 SR
See application file for complete search history.

(56) References Cited

U.S. PATENT DOCUMENTS

| | | | | |
|---|---|---|---|---|
| 5,606,152 | A | 2/1997 | Higashiura et al. | |
| 9,324,476 | B2 * | 4/2016 | Caudill | H01B 3/427 |
| 2001/0010269 | A1 | 8/2001 | Higashiura et al. | |
| 2006/0194051 | A1 | 8/2006 | Fukuda et al. | |
| 2008/0187759 | A1 | 8/2008 | Fukuda et al. | |
| 2011/0192632 | A1 | 8/2011 | Abe et al. | |
| 2013/0032377 | A1 | 2/2013 | Morishita et al. | |
| 2013/0161065 | A1 | 6/2013 | Honda et al. | |

FOREIGN PATENT DOCUMENTS

| | | | |
|---|---|---|---|
| CN | 201655368 | U | 11/2010 |
| JP | 56-93214 | A | 7/1981 |
| JP | 59-40409 | A | 3/1984 |
| JP | 02-027611 | A | 1/1990 |
| JP | 2-250207 | A | 10/1990 |
| JP | 03-56113 | U | 5/1991 |
| JP | 06-223634 | A | 8/1994 |
| JP | 10-134643 | A | 5/1998 |
| JP | 2005-203334 | A | 7/2005 |
| JP | 4579989 | B2 | 11/2010 |
| JP | 2011-165485 | A | 8/2011 |
| JP | 2013-033607 | A | 2/2013 |
| JP | 2013-131423 | A | 7/2013 |
| WO | WO 01/56041 | A1 | 8/2001 |

OTHER PUBLICATIONS

Taiwanese Office Action and Search Report, issued Dec. 17, 2015, for Taiwanese Application No. 102142157, along with English translations.
International Search Report issued in PCT/JP2013/080866 dated Jan. 21, 2014.
Extended European Search Report, dated Jul. 12, 2016, for corresponding European Application No. 13858500.5.
TA Instruments, "Effect of Frequency on the Modulus and Glass Transition Temperature of PET," Thermal Analysis and Rheology, Jun. 10, 2006, 1 page, XP055285376, http://www.tainstruments.com/pdf/literature/TS62.pdf. 1.
Chinese Office Action and Search Report, dated Sep. 1, 2016, for corresponding Chinese Application No. 201380015324.6, as well as an English translation.

* cited by examiner

INSULATED WIRE AND ELECTRIC OR ELECTRONIC EQUIPMENT

CROSS-REFERENCE TO RELATED APPLICATIONS

This application is a continuation of PCT/JP2013/080866 filed on Nov. 15, 2013 which claims benefit of Japanese Patent Application No. 2012-263748 filed on Nov. 30, 2012, the subject matters of which are incorporated herein by reference in their entirety.

TECHNICAL FIELD

The present invention relates to an insulated wire, and electric or electronic equipment. More specifically, the present invention relates to an insulated wire, which is excellent in properties such as heat resistance and is useful as a winding and/or lead wire of a transformer incorporated in the electric or electronic equipment and the like, and electric or electronic equipment such as a transformer using the same.

BACKGROUND ART

The construction of a transformer is prescribed by IEC (International Electrotechnical Communication) standards Pub. 950, 65, 335, 601, etc. Specifically, these standards provide 1) that an enamel film which coats a conductor of a winding be not authorized as an insulating layer, and that at least three insulating layers including an auxiliary insulating layer be formed between primary and secondary windings or 2) that the thickness of an insulating layer be 0.4 mm or more, for example, the creeping distance between the primary and secondary windings, which varies depending on the applied voltage, be 5 mm or more, and 3) that the transformer withstand a voltage of 3,000 V applied between the primary and secondary sides for a minute or longer, and the like.

Accordingly, in a currently prevailing transformer, a cross-section structure such as the one illustrated in FIG. 3 has heretofore been adopted. Specifically, flanged bobbin 2 is fitted in ferrite core 1, and enameled primary winding 4 is wound around bobbin 2 in the state such that insulating barriers 3 for securing the creeping distance are arranged individually at both ends of the periphery of bobbin 2. Then, insulating tape 5 is wound for at least three turns on primary winding 4, insulating barriers 3 for securing the creeping distance are arranged on insulating tape 5, and enameled secondary winding 6 is then wound around the insulating tape in a similar way.

In recent years, however, a transformer having a structure that includes neither insulating barrier 3 nor insulating tape layer 5, as shown in FIG. 2, has been beginning to appear instead of the transformer having the cross-section structure shown in FIG. 3. This transformer has advantages in that the overall size thereof can be reduced compared to the transformer having the structure shown in FIG. 3 and that winding work of insulating tape 5 can be omitted.

In the case of manufacturing the transformer shown in FIG. 2, it is required, in accordance with the IEC standards, that three insulating layers 4*b*, 4*c* and 4*d*, or 6*b*, 6*c* and 6*d* are formed on the outer periphery of one or both of conductors 4*a* or 6*a* of primary winding 4 and secondary winding 6 which are used. Further, the IEC standards require that, in the primary winding 4 and the secondary winding 6, each other's interlayers are identifiable among these insulating layers.

Such a winding is known to have a structure in which an insulating tape is wound on the outer periphery of a conductor to form a first insulating layer and then further the insulating tape is wound around thereon to form a second insulating layer and a third insulating layer in succession, so as to form a three-layer structure insulating layer in which interlayers, namely the number of insulating layers, are identifiable with respect to one another. Further, another winding is also known to have a structure in which a fluorine resin is extrusion-coated in succession on the outer periphery of a conductor enameled with polyurethane so that insulating layers are formed by an extrusion-coated layer having a three-layer structure as a whole (for example, see Patent Literature 1).

In addition, as an insulated wire having a multilayer insulating layer, for example, it has been proposed that in a multilayer insulated wire having a conductor and three or more extrusion-insulating layers coating the conductor, the multilayer insulated wire includes the innermost layer (B) of the insulating layers, the innermost layer (B) being composed of an extrusion-coated layer including resins which contain both a thermoplastic straight-chain polyester resin whose coefficient of extension, when the resin is soaked in a solder bath at 150° C. for 2 seconds, has a specific range and a resin containing an ethylene-based copolymer or a resin containing an epoxy group (Patent Literature 2).

Further, it has also been proposed that "in a multilayer insulated wire having two or more insulating layers on a conductor, the multilayer insulated wire has the insulating layers in which the outermost layer is composed of an extrusion-coated layer of a polyamide resin and the other layers are composed of extrusion-coated layers of polyether sulfone" (Patent Literature 3).

CITATION LIST

Patent Literatures

Patent Literature 1: JU-A-3-56113 ("JU-A" means unexamined published Japanese utility model registration application)

Patent Literature 2: Japanese Patent No. 4579989

Patent Literature 3: JP-A-10-134642 ("JP-A" means unexamined published Japanese patent application)

SUMMARY OF INVENTION

Technical Problem

Recently, however, there is strong demand for downsizing of the transformer, and problems such as increase in an amount of heat generation due to the downsizing have been caused. As a result, there has been much demand which cannot be addressed by B-type of heat-resistant class (index of heat resistance: 130° C.) which the aforementioned three-layer insulated wire has. In order to address such a need, it has been necessary to further improve heat resistance and to develop an insulated wire having F-type of heat-resistant class (index of heat resistance: 155° C.).

Further, there are requests for the insulated wires that insulating layers are tightly adhered to each other so as not to separate from one another with ease, in addition to that, they are excellent in abrasion resistance so as to be able to withstand the shock of coil molding and have resistance to crash.

Meanwhile, insulated wires have been used for electric or electronic equipment which is accompanied by heat generation, such as a motor, or for electric or electronic equipment to be set in usage environments in which ambient temperature moves up and down. As a result, "flexibility before and after heating" which means to retain inherent flexibility even after repeated heating is becoming to be required for insulated wires, in particular those used in such an electric or electronic equipment or environments of usage.

The present invention is contemplated for providing an insulated wire having at least two insulating layers, which satisfies the requirement for improvement in heat resistance and combines requisite characteristics, which are required for a coil use, for examples, thermal shock resistance, flexibility before and after heating, abrasion resistance, and the like.

Further, the present invention is contemplated for providing electric or electronic equipment such as a transformer, in which insulated wires having these requisite characteristics combined are wound around, thereby achieving such a high level of reliability that insulation properties are retained even under severe processing conditions and usage environments.

Solution to Problem

The above-described problems have been achieved by the insulated wire and the transformer using the same described below.

(1) An insulated wire comprising:

a conductor; and a multilayer insulating layer composed of two or more insulating layers coating the conductor, wherein the innermost insulating layer of the multilayer insulating layer is an insulating layer formed of a crystalline thermoplastic resin having a storage elastic modulus of 10 MPa or more at 300° C., wherein outer insulating layer(s) other than the innermost insulating layer include(s) an insulating layer formed of a crystalline thermoplastic resin having a melting point of 260° C. or higher and a storage elastic modulus of 1,000 MPa or more at 25° C., and wherein adjacent insulating layers have a relationship to each other such that the storage elastic modulus at 25° C. of the thermoplastic resin in the insulating layer positioned at the outer side is equal to or smaller than the storage elastic modulus at 25° C. of the thermoplastic resin in the insulating layer positioned at the inner side.

(2) The insulated wire as described in the above-described item (1), wherein the innermost insulating layer is an insulating layer formed of at least one thermoplastic resin selected from the group consisting of a polyetheretherketone resin, a modified polyetheretherketone resin, and a thermoplastic polyimide resin.

(3) The insulated wire as described in the above-described item (1) or (2), wherein at least one of the outer insulating layers of the multilayer insulating layer is an insulating layer formed of a polyamide resin.

(4) The insulated wire as described in any one of the above-described items (1) to (3), wherein the innermost insulating layer is an insulating layer formed of a polyetheretherketone resin or a modified polyetheretherketone resin, and at least one of the outer insulating layers is an insulating layer formed of a polyamide 6,6.

(5) Electric or electronic equipment formed by using the insulated wire as described in any one of the above items (1) to (4) as a winding wire and/or a lead wire of a transformer that is incorporated into the electric or electronic equipment.

In the present invention, the number of the layers of the multilayer insulating layer is determined by an interface of the interlayers at the time when a cross-section of the insulated wire is observed through a microscope.

Other and further features and advantages of the invention will appear more fully from the following description, appropriately referring to the accompanying drawings.

Advantageous Effects of Invention

The insulated wire of the present invention satisfies a sufficient level of heat resistance and is also excellent in thermal shock resistance, flexibility before and after heating, and abrasion resistance, each of which is required for a coil use. As a result, the present invention is able to provide an insulated wire which is excellent in thermal shock resistance, flexibility before and after heating, and abrasion resistance, while maintaining heat resistance with F-type or greater of heat-resistant class. Further, electric or electronic equipment such as a transformer or the like, which uses the insulated wire of the present invention which has combined the above-described characteristics, retains insulation properties even under severe processing conditions and usage environments, thereby providing a high level of reliability.

DESCRIPTION OF EMBODIMENTS

Figure 1A:
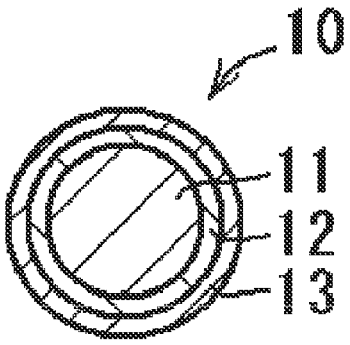
FIG. 1(*a*) is a cross-sectional view showing an example of the insulated wire of the present invention, and FIG. 1(*b*) is a cross-sectional view showing another example of the insulated wire of the present invention.

The present invention is an insulated wire including a conductor and a multilayer insulating layer composed of two or more layers coating the conductor, in which the innermost insulating layer of the multilayer insulating layer is an insulating layer formed of a crystalline thermoplastic resin having a storage elastic modulus of 10 MPa or more at 300° C. and the outer insulating layers other than the innermost insulating layer include an insulating layer formed of a crystalline thermoplastic resin having a melting point is 260° C. or higher and a storage elastic modulus of 1,000 MPa or more at 25° C., and adjacent insulating layers have a relationship to each other such that the storage elastic modulus at 25° C. of the thermoplastic resin in the insulating layer positioned at the outer side is equal to or smaller than the storage elastic modulus at 25° C. of the thermoplastic resin in the insulating layer positioned at the inner side.

The storage elastic modulus of the thermoplastic resin which forms each insulating layer of the insulated wire of the present invention is a value that is measured by using a viscoelasticity analyzer (DMS200 (trade name): manufactured by Seiko Instruments Inc.). In particular, by using a 0.2 mm thick specimen which has been prepared with the thermoplastic resin which forms each insulating layer of the insulated wire, a value of the storage elastic modulus is recorded at the time when temperature reaches 25° C. and 300° C. respectively under the conditions that a rate of temperature increase is 2° C./min and a frequency is 10 Hz. The recorded value is defined as a storage elastic modulus at 25° C. or 300° C. of the thermoplastic resin.

The melting point of the thermoplastic resin can be measured by, for example, differential scanning calorimetry (DSC). Specifically, the melting point can be measured by reading a peak temperature attributable to melting of the sample (10 mg) seen in the range over 250° C. at a temperature-increasing rate of 5° C./min using a thermal analysis instrument, DSC-60 (trade name, manufactured by Shimadzu Corporation). It should be noted that when the thermoplastic resin has a plurality of peak temperatures, the higher peak temperature is determined as the melting point of the resin, The insulated wire of the present invention is provided with a multilayer insulating layer composed of two or more layers as an insulating layer coating a conductor. In the present invention, the insulating layer which constitutes the multilayer insulating layer is at least two layers, and particularly preferably three layers. In the present invention, among the multilayer insulating layer, the insulating layer which comes close to the conductor and coats the conductor therewith is called the innermost insulating layer, insulating layers other than the innermost insulating layer are called the outer insulating layers, and the insulating layer which is most remote from the conductor among the outer insulating layers is called the outermost insulating layer.

The structures of the preferable embodiments of the insulated wire of the present invention are explained.

Figure 1B:
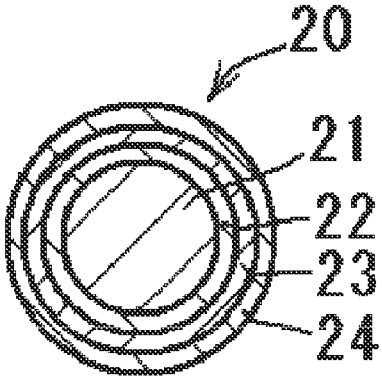

One embodiment thereof includes insulated wire 10 having two insulating layers shown in FIG. 1(*a*). This insulated wire 10 has, as shown in FIG. 1(*a*), conductor 11, innermost insulating layer 12 which coats conductor 11, and outermost insulating layer 13 which coats innermost insulating layer 12. In this insulated wire 10, outermost insulating layer 13 is an outer insulating layer at once.

Further, another embodiment thereof includes insulated wire 20 having three insulating layers shown in FIG. 1(*b*). This insulated wire 20 has, as shown in FIG. 1(*b*), conductor 21, innermost insulating layer 22 which coats conductor 21, interlayer insulating layer 23 which coats innermost insulating layer 22, and outermost insulating layer 24 which coats interlayer insulating layer 23. In this insulated wire 20, interlayer insulating layer 23 and outermost insulating layer 24 constitute outer insulating layers.

It should be noted that the scope of the present invention is not limited only to these embodiments, but a variety of modifications can be applied thereto, as long as the intent of the present invention does not become impaired. For example, innermost insulating layer 12 or 22 may coat directly conductor 11 or 21 as shown in FIG. 1, or may coat the conductor via another layer.

As conductor 11, a metal bare wire (singlet), or a multi-stranded wire obtained by twisting a plurality of metal bare wires may be used. The number of stranded wires in the wire may be optionally selected depending on the high-frequency application. When the number of metal bare wires is large, the core wire may be in a form of a non-stranded wire. In the case of the non-stranded wire, for example, a plurality of metal bare wires may be gathered together to bundle them together in an approximately parallel direction, or the bundle of them may be intertwined in a very large pitch. In each case, it is preferable that the cross section of conductor 11 have an almost circular shape. The metal which constitutes conductor 11 is not particularly limited, and examples thereof include copper, copper alloy, and the like.

Innermost insulating layer 12 or 22 in the multilayer insulating layer is a coating layer formed of a crystalline thermoplastic resin. When innermost insulating layer 12 or 22 is formed of a crystalline thermoplastic resin, the insulated wire exerts high heat resistance. This innermost insulating layer 12 or 22 is a coating layer formed of a thermoplastic resin having a storage elastic modulus of 10 MPa or more at 300° C. A thermoplastic resin having a storage elastic modulus of less than 10 MPa at 300° C. is not provided with heat resistance required for the insulated wire, and therefore such a thermoplastic resin is not preferable for innermost insulating layer 12 or 22. The storage elastic modulus of a thermoplastic resin which forms innermost insulating layer 12 or 22 is preferably 50 MPa or more. The upper limit of the storage elastic modulus is not particularly limited, but 500 MPa is practical and preferably 200 MPa.

The thermoplastic resin which forms innermost insulating layer 12 or 22 is not particularly limited in terms of other physical properties, as long as the storage elastic modulus at 300° C. is in the above-described range. For example, the storage elastic modulus at 25° C. of this thermoplastic resin is not particularly limited. As an example, the storage elastic modulus at 25° C. is preferably from 1,500 to 6,000 MPa, and more preferably from 1,800 to 4,000 MPa. Further, the melting point of the thermoplastic resin which forms innermost insulating layer 12 or 22 is not also particularly limited. As an example, the melting point of the thermoplastic resin is preferably from 310 to 400° C., and more preferably from 340 to 390° C. When the storage elastic modulus at 25° C. and the melting point of the thermoplastic resin are each in the above-described range, the insulated wire exerts high heat resistance.

The thermoplastic resin which forms innermost insulating layer 12 or 22 is not particularly limited, as long as it is a crystalline thermoplastic resin having a storage elastic modulus of 10 MPa or more at 300° C., and the thermoplastic resin is adequately selected while taking the storage elastic modulus at 300° C. and the crystalline property into consideration. Examples of such a thermoplastic resin include a polyetheretherketone resin (hereinafter referred to as PEEK), a modified polyetheretherketone resin (hereinafter referred to as modified PEEK), and a thermoplastic polyimide resin (hereinafter referred to as thermoplastic PI) and the like. In the present invention, the thermoplastic resin is preferably at least one thermoplastic resin selected from the group consisting of a PEEK resin, a modified PEEK resin and a thermoplastic PI resin. Among the crystalline thermoplastic resins having a storage elastic modulus of 10 MPa or more at 300° C., PEEK, modified PEEK and thermoplastic PI are also excellent in thermal aging resistance in particular. Further, of these thermoplastic resins, PEEK resin and modified PEEK resin are more preferable. These resins are excellent in thermal aging resistance and also excellent in abrasion resistance because the storage elastic modulus at room temperature is high.

Examples of the thermoplastic polyimide resin include an aromatic thermoplastic polyimide and an aliphatic thermoplastic polyimide. These thermoplastic polyimides are obtained by reacting an acid component and a diamine component or a diisocyanate component.

Examples of the acid component of the thermoplastic polyimide resin include each of components such as pyromellitic dianhydride, 3,3',4,4'-benzophenone tetracarboxylic dianhydride, 2,3,3',4'-benzophenone tetracarboxylic dianhydride, 2,2',3,3'-benzophenone tetracarboxylic dianhydride, 3,3',4,4'-biphenyltetracarboxylic dianhydride, 2,2',3,3'-biphenyltetracarboxylic dianhydride, 2,2-bis(2,3-dicarboxyphenyl)propane dianhydride, bis(3,4-dicarboxyphenyl)ether dianhydride, bis(3,4-dicarboxyphenyl)sulfone dianhydride, 1,1-bis(2,3-dicarboxyphenyl)ethane dianhydride, bis(2,3-dicarboxyphenyl)methane dianhydride, bis(3,4-dicarboxyphenyl)methane dianhydride, 2,2'-bis(3,4-dicarboxyphenyl)-1,1,1,3,3,3-hexafluoropropane dianhydride, 1,4-difluoro pyromellitic acid, 1,4-bis(trifluoromethyl)pyromellitic acid, 1,4-bis(3,4-dicarboxytrifluorophenoxy)tetrafluorobenzene dianhydride, 2,2'-bis[4-(3,4-dicarboxyphenoxy)benzene]-1,1,1,3,3,3-hexafluoropropane dianhydride, 2,3,6,7-naphthalene tetracarboxylic dianhydride, 1,4,5,8-naphthalene tetracarboxylic dianhydride, 1,2,5,6-naphthalene tetracarboxylic dianhydride, 1,2,3,4-benzene tetracarboxylic dianhydride, 3,4,9,10-perylene tetracarboxylic dianhydride, 2,3,6,7-anthrathene tetracarboxylic dianhydride, 1,2,7,8-phenanthrene tetracarboxylic dianhydride, 1,2,3,4-butane tetracarboxylic dianhydride, 1,2,3,4-cyclobutane tetracarboxylic dianhydride, and the like, and in addition, ring-opened hydrolysates that these components have been at least partially ring-opened by hydrolysis.

Examples of the diamine component or the diisocyanate component of the polyimide resin include each of components such as 4,4'-bis(3-aminophenoxy) biphenyl, m-phenylenediamine, o-phenylenediamine, p-phenylenediamine, m-aminobenzylamine, p-aminobenzylamine, 4,4'-diaminodiphenylether, 3,3'-diaminodiphenylether, 3,4'-diaminodiphenylether, bis(3-aminophenyl) sulfide, bis(4-aminophenyl) sulfide, (3-aminophenyl) (4-aminophenyl) sulfide, bis(3-aminophenyl) sulfoxide, bis(4-aminophenyl) sulfoxide, (3-aminophenyl) (4-aminophenyl) sulfoxide, bis(3-aminophenyl) sulfone, bis(4-aminophenyl) sulfone, (3-aminophenyl) (4-aminophenyl) sulfone, 3,3'-diaminobenzophenone, 4,4'-diaminobenzophenone, 3,4'-diaminobenzophenone, 3,3'-diaminodiphenylmethane, 4,4'-diaminodiphenylmethane, 3,4'-diaminodiphenylmethane, bis[4-(3-aminophenoxy)phenyl]methane, bis[4-(4-aminophenoxy)phenyl]methane, 1,1-bis[4-(3-aminophenoxy)phenyl]ethane, 1,2-bis[4-(3-aminophenoxy)phenyl]ethane, 1,1-bis[4-(4-aminophenoxy)phenyl]ethane, 1,2-bis[4-(4-aminophenoxy)phenyl]ethane, 2,2-bis[4-(3-aminophenoxy)phenyl]propane, 2,2-bis[4-(4-aminophenoxy)phenyl]propane, 2,2-bis[4-(3-aminophenoxy)phenyl]butane, 2,2-bis[3-(3-aminophenoxy)phenyl]-1,1,1,3,3,3-hexafluoropropane, 2,2-bis[4-(4-aminophenoxy)phenyl]-1,1,1,3,3,3-hexafluoropropane, 1,3-bis(3-aminophenoxy)benzene, 1,3-bis(4-aminophenoxy)benzene, 1,4-bis(3-aminophenoxy)benzene, 1,4-bis(4-aminophenoxy)benzene, 4,4'-bis(4-aminophenoxy) biphenyl, bis[4-(3-aminophenoxy)phenyl]ketone, bis[4-(4-aminophenoxy)phenyl]ketone, bis[4-(3-aminophenoxy)phenyl]sulfide, bis[4-(4-aminophenoxy)phenyl]sulfide, bis[4-(3-aminophenoxy)phenyl]sulfoxide, bis[4-(4-aminophenoxy)phenyl]sulfoxide, bis[4-(3-aminophenoxy)phenyl]sulfone, bis[4-(4-aminophenoxy)phenyl]sulfone, bis[4-(3-aminophenoxy)phenyl]ether, bis[4-(4-aminophenoxy)phenyl]ether, 1,4-bis[4-(3-aminophenoxy)benzoyl]benzene, 1,3-bis[4-(3-aminophenoxy)benzoyl]benzene, 4,4'-bis[3-(4-aminophenoxy)benzoyl]diphenylether, 4,4'-bis[3-(3-aminophenoxy)benzoyl]diphenylether, 4,4'-bis[4-(4-amino-α,α-dimethylbenzyl)phenoxy]benzophenone, 4,4'-bis[4-(4-amino-α,α-dimethylbenzyl)phenoxy]diphenylsulfone, bis[4-{4-(4-aminophenoxy)phenoxy}phenyl]sulfone, 1,4-bis[4-(4-aminophenoxy)phenoxy-α,α-dimethylbenzyl]benzene, 1,3-bis[4-(4-aminophenoxy)phenoxy-α,α-dimethylbenzyl]benzene, 1,3-bis[4-(4-amino-6-trifluoromethylphenoxy)-α,α-dimethylbenzyl]benzene, 1,3-bis[4-(4-amino-6-fluorophenoxy)-α,α-dimethylbenzyl]benzene, 1,3-bis[4-(4-amino-6-methylphenoxy)-α,α-dimethylbenzyl]benzene, 1,3-bis[4-(4-amino-6-cyanophenoxy)-α,α-dimethylbenzyl]benzene, 3,3'-diamino-4,4'-diphenoxybenzophenone, 4,4'-diamino-5,5'-diphenoxybenzophenone, 3,4'-diamino-4,5'-diphenoxybenzophenone, 3,3'-diamino-4-phenoxybenzophenone, 4,4'-diamino-5-phenoxybenzophenone, 3,4'-diamino-4-phenoxybenzophenone, 3,4'-diamino-5'-phenoxybenzophenone, 3,3'-diamino-4,4'-dibiphenoxybenzophenone, 4,4'-diamino-5,5'-dibiphenoxybenzophenone, 3,4'-diamino-4,5'-dibiphenoxybenzophenone, 3,3'-diamino-4-biphenoxybenzophenone, 4,4'-diamino-5-biphenoxybenzophenone, 3,4'-diamino-4-biphenoxybenzophenone, 3,4'-diamino-5'-biphenoxybenzophenone, 1,3-bis(3-amino-4-phenoxybenzoyl)benzene, 1,4-bis(3-amino-4-phenoxybenzoyl)benzene, 1,3-bis(4-amino-5-phenoxybenzoyl)benzene, 1,4-bis(4-amino-5-phenoxybenzoyl)benzene, 1,3-bis(3-amino-4-biphenoxybenzoyl)benzene, 1,4-bis(3-amino-4-biphenoxybenzoyl)benzene, 1,3-bis(4-amino-5-biphenoxybenzoyl)benzene, 1,4-bis(4-amino-5-biphenoxybenzoyl)benzene, 2,6-bis[4-(4-amino-α,α-dimethylbenzyl)phenoxy]benzonitrile, 6,6'-bis(2-aminophenoxy)-3,3,3',3'-tetramethyl-1,1'-spirobiindane, 6,6'-bis(3-aminophenoxy)-3,3,3',3'-tetramethyl-1,1'-spirobiindane, 6,6'-bis(3-aminophenoxy)-3,3,3',3'-tetramethyl-1,1'-spirobiindane, and the diisocyanates having isocyanate groups in place of these amino groups.

Innermost insulating layer 12 or 22 is formed preferably by extrusion-molding these thermoplastic resins together with conductor 11 or 21. It should be noted that innermost insulating layer 12 or 22 may also be formed by extrusion-molding a resin composition in which various kinds of additives have been mixed in these thermoplastic resins. The various kinds of additives to be mixed in this process include those which are ordinarily added to the thermoplastic resin compositions without any limitation in particular.

The outer insulating layer other than innermost insulating layer 12 or 22 is a coating layer which has been formed of a crystalline thermoplastic resin. When the outer insulating layer is formed of a crystalline thermoplastic resin, the insulated wire exerts high heat resistance. This outer insulating layer, namely, each of outermost insulating layer 13 of insulated wire 10, interlayer insulating layer 23 and outermost insulating layer 24 of insulated wire 20 is a coating layer which has been formed of a thermoplastic resin having a melting point of 260° C. or higher and a storage elastic modulus of 1,000 MPa or more at 25° C. When the melting point of the thermoplastic resin is lower than 260° C., heat resistance required for the insulated wire cannot be obtained or flexibility of the insulated wire decreases due to melting thereof and therefore this is not preferable for the outer insulating layer. The melting point of the thermoplastic resin is preferably 270° C. or higher. Although the melting point is not limited in particular, it is favorably 390° C. or lower in practice and more favorably equal to or lower than the melting point of the thermoplastic resin which forms innermost insulating layer 12 or 22. For example, the melting point is preferably 350° C. or lower.

When the storage elastic modulus of the thermoplastic resin is less than 1,000 MPa, both heat resistance and abrasion resistance required for the insulated wire are not obtained and therefore such a resin is not preferable for the outer insulating layer. The storage elastic modulus of the thermoplastic resin is 1,500 MPa or more in that the insulated wire exerts much higher abrasion resistance. Although this storage elastic modulus is not limited in particular, it is practically 5,000 MPa or less and preferably 4,000 MPa or less.

Here, it is preferable that a thermoplastic resin which forms the innermost insulating layer be not included in a thermoplastic resin which forms the outermost insulating layer, and each of the outermost insulating layer and the innermost insulating layer be formed of a thermoplastic resin having a different storage elastic modulus at 25° C. from one another. With respect to a relation between the other layers which constitute a multilayer insulating layer, the insulating layer which is positioned at the outer side thereof just has to be formed of a thermoplastic resin of which storage elastic modulus is equal to or smaller than that of the other insulating layer at the inner side thereof.

In the insulated wire of the present invention, adjacent insulating layers including the innermost layer have a relationship to each other such that the storage elastic modulus at 25° C. of the thermoplastic resin in the insulating layer positioned at the outer side is equal to or smaller than the storage elastic modulus at 25° C. of the thermoplastic resin in the insulating layer positioned at the inner side.

In insulated wires 10 and 20, the outer insulating layer is formed of a thermoplastic resin having a smaller value of storage elastic modulus at 25° C. than the thermoplastic resin which forms innermost insulating layer 12 or 22. Thus, when the outer insulating layer is formed of a thermoplastic resin having a smaller storage elastic modulus than innermost insulating layer 12 or 22, an insulated wire is obtained with advantages that interlayer adhesion is so high that the layers hardly separate from each other, and also flexibility before and after heating is excellent. In the case where there is a difference in storage elastic modulus between these layers, a difference in storage elastic modulus between innermost insulating layer 12 or 22 and the outer insulating layer is not limited in particular, and for example, it is favorably from 500 to 5,000 MPa.

In insulated wire 20, the same relationship of the storage elastic modulus is also built between interlayer insulating layer 23 and outermost insulating layer 24. Specifically, between the adjacent two insulating layers of interlayer insulating layer 23 and outermost insulating layer 24, the relationship is built such that the storage elastic modulus at 25° C. of the thermoplastic resin in outermost insulating layer 24 is equal to or smaller than the storage elastic modulus at 25° C. of the thermoplastic resin in interlayer insulating layer 23. Thus, when the above-described relationship is built between the adjacent two outer insulating layers, an insulated wire is obtained with advantages that interlayer adhesion is so high that the layers hardly separate from each other, and also flexibility before and after heating is excellent. This provides an insulated wire of the present invention in which interlayer adhesion is so high that the layers hardly separate from each other, and also flexibility before and after heating is excellent. The interlayer adhesion also affects abrasion resistance of the electric wire. It should be noted that a difference in storage elastic modulus between the thermoplastic resins which form the adjacent two outer insulating layers is not limited in particular, and for example, it is favorably from 0 to 2,000 MPa.

Thus, in insulated wire 10 and insulated wire 20 which are preferable embodiments of the present invention, between the adjacent two insulating layers including innermost insulating layers 12 and 22, the relationship is built such that the storage elastic modulus at 25° C. of the thermoplastic resin of the insulating layer which is positioned at the outer side is equal to or smaller than the storage elastic modulus at 25° C. of the thermoplastic resin which is positioned at the inner side. In addition, also between innermost insulating layers 12, 22 and outermost insulating layers 13, 24, the relationship is built such that the storage elastic modulus at 25° C. of the thermoplastic resin of each of the outermost insulating layers 13 and 24 is smaller than the storage elastic modulus at 25° C. of the thermoplastic resin of each of innermost insulating layers 12 and 22.

By satisfying such a relationship with respect to storage elastic modulus at 25° C., thermal shock resistance, flexibility before and after heating, and abrasion resistance are exerted in a higher level in a balanced manner.

The thermoplastic resins which form outer insulating layers 13, 23 and 24 only have to be crystalline thermoplastic resins having a melting point of 260° C. or higher and a storage elastic modulus of 1,000 MPa or more at 25° C. Such thermoplastic resins are adequately selected by considering the melting point, the storage elastic modulus at 25° C., the crystalline property and the like. Examples of these thermoplastic resins include a PEEK resin, a modified PEEK resin, and a thermoplastic PI resin, a polyphenylene sulfide resin (hereinafter referred to as PPS), a syndiotactic polystyrene resin (hereinafter referred to as SPS), and a polyamide resin (hereinafter referred to as PA). The thermoplastic polyimide resin is the same as described above. Examples of PA include polyamide 6,6, polyamide 4,6, polyamide 6, T, polyamide 9, T, polyphthalamide and the like. This thermoplastic resin is preferably at least one selected from the group consisting of PPS, SPS and PA, more preferably PA, and particularly preferably polyamide 6,6 (also referred to as PA66).

For the thermoplastic resins which form innermost insulating layers 12 and 22, and outer insulating layers 13, 23 and 24, commercially available products may also be used. Examples of the commercially available products include PEEK450G manufactured by Victrex Japan Inc. (trade name, storage elastic modulus at 25° C.: 3840 MPa, storage elastic modulus at 300° C.: 187 MPa, melting point: 345° C.) as the PEEK; AVASPIRE AV-650 manufactured by Solvay S.A. (trade name, storage elastic modulus at 25° C.: 3,700 MPa, storage elastic modulus at 300° C.: 144 MPa, melting point: 340° C.) or AV-651 (trade name, storage elastic modulus at 25° C.: 3,500 MPa, storage elastic modulus at 300° C.: 130 MPa, melting point: 345° C.) as the modified PEEK; AURUM PL 450C manufactured by Mitsui Chemicals, Inc. (trade name, storage elastic modulus at 25° C.: 1880 MPa, storage elastic modulus at 300° C.: 18.9 MPa, melting point: 388° C.) as thermoplastic PI; FORTRON 0220A9 manufactured by Polyplastics Co., Ltd. (trade name, storage elastic modulus at 25° C.: 2,800 MPa, storage elastic modulus at 300° C.: <10 MPa, melting point: 278° C.), or FZ-2100, namely, PPS manufactured by DIC Corporation (trade name, storage elastic modulus at 25° C.: 1,600 MPa, storage elastic modulus at 300° C.: <10 MPa, melting point: 275° C.) as the PPS; XAREC S105 manufactured by Idemitsu Kosan Co., Ltd. (trade name, storage elastic modulus at 25° C.: 2,200 MPa, melting point: 280° C.) as the SPS; FDK-1, namely, polyamide 6,6 manufactured by UNITIKA LTD. (trade name, storage elastic modulus at 25° C.: 1,200 MPa, storage elastic modulus at 300° C.: <10 MPa, melting point: 265° C.), F-5000, namely, polyamide 4,6 manufactured by UNITIKA LTD. (trade name, storage elastic modulus at 25° C.: 1,100 MPa, melting point: 292° C.), ARLENE AE-420, namely, polyamide 6, T manufactured by Mitsui Chemicals, Inc. (trade name, storage elastic modulus at 25° C.: 2,400 MPa, melting point: 320° C.), and GENESTOR N-1006D, namely, polyamide 9, T manufactured by KURARAY CO., LTD. (trade name, storage elastic modulus at 25° C.: 1,400 MPa, melting point: 262° C.) as the PA.

Outer insulating layers 13, 23 and 24 are each preferably formed by extrusion-molding the above-described thermoplastic resins together with conductor 11 or 21 having innermost insulating layer 11 or 21 formed thereon. It should be noted that outer insulating layers 13, 23 and 24 may be formed by extrusion-molding resin compositions in which various kinds of additives have been mixed in these thermoplastic resins. The various kinds of additives to be mixed in this process are the same as described above.

It should be noted that if the multilayer insulating layer has innermost insulating layer 12 or 22 and outer insulating layers 13, 23 and 24, the multilayer insulating layer may have insulating layers which do not correspond to these layers, that is, insulating layers which have been formed of thermoplastic resins other than thermoplastic resins which form innermost insulating layers 12 and 22 as well as outer insulating layers 13, 23 and 24. A melting point of the thermoplastic resin which forms the foregoing insulating layers is preferably 250° C. or higher.

The insulated wire of the present invention is produced, in the usual manner, by extrusion-coating insulating layers in succession according to a method of repeatedly extrusion-coating the insulating layers such that a first insulating layer with a desired thickness, namely the innermost insulating layer is extrusion-coated on the outer periphery of a conductor, and then a second layer with a desired thickness is extrusion-coated on the outer periphery of the first insulating layer, and further optionally a third layer with a desired thickness is extrusion-coated on the outer periphery of the second insulating layer. A total thickness of the thus-formed multilayer insulating layer in terms of all the layers is preferably adjusted to a range of 50 to 180 μm. If the total thickness of the multilayer insulating layer is too thin, significant reduction in electric characteristics of the obtained insulated wire is caused and this may be unfit for a practical use. On the contrary, if it is too thick, this is unfit for downsizing and coil-working may become difficult. A more preferable range of the total thickness of the multilayer insulating layer in terms of all the layers is from 60 to 150 μm. At this time, the thickness of each of the layers which constitute the multilayer insulating layer is preferably selected from the range of 20 to 60 μm so that the thickness of all the layers becomes within the above-described range.

With respect to the thickness of the multilayer insulating layer, if emphasis is placed on the flexibility of the insulated wire, it is preferred that the thickness of the innermost insulating layer be within the above-described range and adjusted to make it thinner than the thickness of the outer insulating layer.

While the insulated wire of the present invention exerts high heat resistance of F-type or more of heat resistant class which has not been realized in the past, the insulated wire is excellent in thermal shock resistance, abrasion resistance, and flexibility before and after heating. In addition to conventional intended uses, the insulated wire of the present invention which has such characteristics is used for electric or electronic equipment which is accompanied by heat generation, or electric or electronic equipment to be set in an environment in which ambient temperature moves up and down. Specifically, it is useful for a coil use, particularly useful for a coil use in which heat resistance of F-type or more of heat resistant class is required (index of heat resistance: 155° C.).

Figure 2:
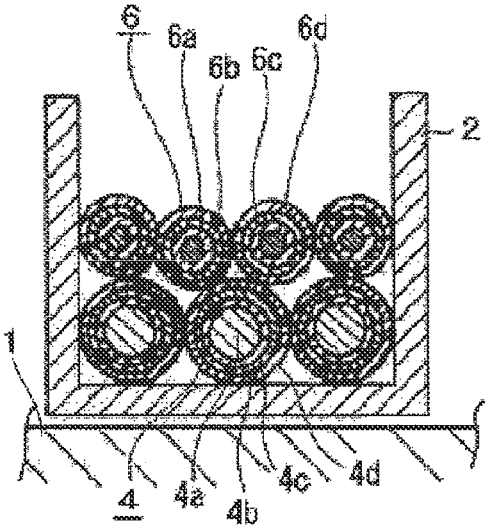
FIG. 2 is a cross-sectional view showing an example of a transformer having a structure in which a three-layer insulated wire is used as a winding.
Figure 3:
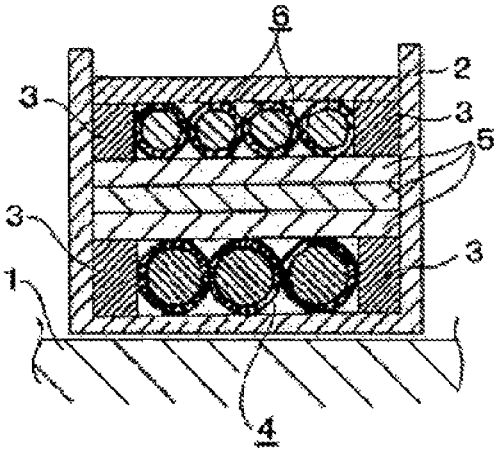
FIG. 3 is a cross-sectional view showing one example of a transformer having a conventional structure.

As one embodiment of suitable transformers using the insulated wire of the present invention, for example, insulated wires 10 and 20 shown in FIG. 1, a transformer shown in FIG. 2 is exemplified. This transformer is a small sized one, and specifically the insulated wires of the present invention are wound around as primary winding 4 and secondary winding 6 in bobbin 2 fitted in ferrite core 1, by incorporating therein neither an insulating barrier nor an insulating tape layer. As this transformer uses the insulated wire of the present invention, it is excellent in electric characteristics and it retains insulation properties to exert high reliability under harsh processing conditions and usage environments, to say nothing of the conventional processing conditions and usage environments. Further, the insulated wire of the present invention can be applied to another type of transformers, and for example, can also be applied to the transformer having the conventional structure shown in FIG. 3. Therefore, the transformer of the present invention includes the transformer having the conventional structure shown in FIG. 3 in addition to the suitable transformer shown in FIG. 2.

EXAMPLES

The present invention will be described in more detail based on examples given below, but the invention is not meant to be limited by these.

Examples 1 to 10 and Comparative Examples 1 to 6

Insulated wire 10 shown in FIG. 1 (*a*) was produced in Examples 1 and 2 and Comparative Example 1, and insulated wire 20 shown in FIG. 1 (*b*) was produced in Examples 3 to 10 and Comparative Examples 2 to 6. In these Examples and Comparative Examples, "First layer" in Table 1 corresponds to "the innermost insulating layer" of the insulated wire. Further, "Second layer" in Table 1 corresponds to "the outermost insulating layer" in Examples 1 and 2 and Comparative Example 1, and the Second layer corresponds to "an interlayer insulating layer" in Examples 3 to 10 and Comparative Examples 2 to 6. "Third layer" in Table 1 corresponds to "the outermost insulating layer" in Examples 3 to 10 and Comparative Examples 2 to 6.

An annealed copper wire with a wire diameter of 1.0 mm was prepared as a conductor. Insulated wires 10 or 20 having conductor 11 or 21, innermost insulating layer 12 or 22, optionally interlayer insulating layer 23, and outermost insulating layer 13 or 24 were respectively produced by extruding, on the conductor in succession, a thermoplastic resin of each layer shown in Table 1 so as to have a film thickness shown in Table 1 and thereby coating the conductor with the thermoplastic resin.

Tests on various kinds of characteristics shown below were conducted in each of the insulated wires produced above.

The thermoplastic resins used in Examples 1 to 10 and Comparative Examples 1 to 6 are shown below. In addition, their melting points, storage elastic moduli at 25° C., and storage elastic moduli at 300° C. are shown in Table 1. It should be noted that all the used thermoplastic resins were crystalline.

PEEK: PEEK450G (trade name, manufactured by Victrex Japan Inc.)

Modified PEEK: AVASPIRE AV-650 (trade name, manufactured by Solvay S.A.)

Thermoplastic PI: AURUM PL 450C (trade name, manufactured by Mitsui Chemicals, Inc.)

PPS: DIC-PPS FZ-2100 (trade name, manufactured by DIC Corporation)

SPS: XAREC S105 (trade name, manufactured by Idemitsu Kosan Co., Ltd.)

PA66: FDK-1 (trade name, manufactured by UNITIKA LTD.)

PBN: TQB-KT (trade name, manufactured by TEIJIN CHEMICALS LTD.)

ETFE: Fluon ETFE C-55AP (trade name, manufactured by ASAHI GLASS CO., LTD.)

(A) Thermal Shock (Annex 3.0 kV) Test

Thermal shock of each of the insulated wires produced in Examples and Comparative Examples was evaluated by a test method in conformity to IEC standards Pub. 60950. That is, the insulated wires were wound ten turns around a mandrel with a diameter of 10 mm while applying a load of 9.4 kg. They were heated at 250° C. for 1 hour, and further heated at 175° C. for 21 hours and at 225° C. for 3 hours 3 cycles respectively, and then kept in an atmosphere of 30° C. and humidity 95% for 48 hours. Thereafter, a voltage of 3,000 V was applied thereto for 1 minute. When there was no electric short-circuit, it was determined that it passed the standards. As a result of the subsequent applying the voltage until breakdown, a sample whose breakdown voltage was 4,000 V or more was indicated by "⊙", and a sample whose breakdown voltage was 4,000 V or less was indicated by "○". Judgment was conducted by evaluating five samples (n=5), and if any of the five samples should show electric short-circuit, it was determined that they failed to pass the standards, and were indicated by "×". Meanwhile, if the sample is judged as "pass (evaluation is ○ or greater)" in this thermal shock test, this sample satisfies thermal shock resistance required for the coil use. Further, it is easily understood that the thermal resistance of F-type of thermal resistant class (index of thermal resistance: 155° C.) can be satisfied by this sample.

(B) Flexibility Test

Flexibility after heating of the obtained insulated wire was evaluated. The insulated wire was heated at 250° C. for 30 minutes, and after cooling, the insulated wire was tightly wound around a mandrel rod with a diameter of 10 mm 10 times so that adjoining wires are in contact with each other, and then the insulated wire was observed using a 50-power microscope. When there was no defect such as crack, film-float and the like in the insulating layer of the insulated wire, it was determined that it passed the standards, and indicated by "○" in Table 1. When there was a defect such as crack, film-float and the like in the insulating layer of the insulated wire, it was determined that it failed to pass the standards, and indicated by "×" in Table 1. It should be noted that in the insulated wire, since the flexibility test after heating is an accelerating test (harsh test), if it is judged as "pass" in flexibility test after heating at 250° C. for 30 minutes, it is naturally recognized as "pass" in flexibility test before the heating at 250° C. for 30 minutes.

(C) Abrasion Resistance (Reciprocating Abrasion Test)

Abrasion resistance was evaluated by a reciprocating abrasion test using a reciprocating abrasion testing machine. This reciprocating abrasion testing machine is a testing machine which measures, when the surface of an insulated wire is scratched with a needle by applying a certain load, the number of occurrences of conductor exposure at the coating surface, and thereby the coating film strength can be measured. The abrasion resistance was evaluated if the number of reciprocating abrasion reached 50 times when the load was set to 500 g. When the number of reciprocating abrasion was 50 times or more, it was determined that it passed the standards and indicated by "○" in Table 1. When the number was 70 times or more, it was determined that it had particularly excellent abrasion resistance and indicated by "⊙" in Table 1. When the number of reciprocating abrasion was less than 50 times, it was determined that it did not pass the standards and indicated by "×" in Table 1.

TABLE 1

| | | Ex. 1 | Ex. 2 | Ex. 3 | Ex. 4 | Ex. 5 |
|---|---|---|---|---|---|---|
| First layer | Thermoplastic resin | PEEK | Thermoplastic PI | PEEK | PEEK | PEEK |
| | Film thickness (μm) | 50 | 50 | 33 | 33 | 33 |
| | Melting point (° C.) | 345 | 388 | 345 | 345 | 345 |
| | Storage elastic Modulus (MPa: 25° C.) | 3840 | 1880 | 3840 | 3840 | 3840 |
| | Storage elastic modulus (MPa: 300° C.) | 187 | 18.9 | 187 | 187 | 187 |
| Second layer | Thermoplastic resin | PA66 | PA66 | PPS | PPS | PEEK |
| | Film thickness (μm) | 50 | 50 | 34 | 34 | 34 |
| | Melting point (° C.) | 265 | 265 | 275 | 275 | 345 |
| | Storage elastic Modulus (MPa: 25° C.) | 1200 | 1200 | 1600 | 1600 | 3840 |
| Third layer | Thermoplastic resin | | | PA66 | PPS | PA66 |
| | Film thickness (μm) | | | 33 | 33 | 33 |
| | Melting point (° C.) | | | 265 | 275 | 265 |
| | Storage elastic Modulus (MPa: 25° C.) | | | 1200 | 1600 | 1200 |
| Total film thickness (μm) | | 100 | 100 | 100 | 100 | 100 |
| Characteristics of wire | Thermal shock test | ⊙ | ⊙ | ⊙ | ⊙ | ⊙ |
| | Flexibility | ○ | ○ | ○ | ○ | ○ |
| | Abrasion resistance | ⊙ | ⊙ | ⊙ | ○ | ⊙ |

| | | Ex. 6 | Ex. 7 | Ex. 8 | Ex. 9 | Ex. 10 |
|---|---|---|---|---|---|---|
| First layer | Thermoplastic resin | PEEK | PEEK | PEEK | Thermoplastic PI | Modified PEEK |
| | Film thickness (μm) | 33 | 33 | 33 | 33 | 33 |

TABLE 1-continued

| | | | | | | |
|---|---|---|---|---|---|---|
| | Melting point (° C.) | 345 | 345 | 345 | 388 | 340 |
| | Storage elastic Modulus (MPa: 25° C.) | 3840 | 3840 | 3840 | 1880 | 3700 |
| | Storage elastic modulus (MPa: 300° C.) | 187 | 187 | 187 | 18.9 | 144 |
| Second layer | Thermoplastic resin | SPS | Modified PEEK | PA66 | PPS | PPS |
| | Film thickness (μm) | 34 | 33 | 34 | 34 | 34 |
| | Melting point (° C.) | 280 | 340 | 265 | 275 | 275 |
| | Storage elastic Modulus (MPa: 25° C.) | 2200 | 3700 | 1200 | 1600 | 1600 |
| Third layer | Thermoplastic resin | PA66 | PPS | PA66 | PA66 | PA66 |
| | Film thickness (μm) | 33 | 34 | 33 | 33 | 33 |
| | Melting point (° C.) | 265 | 275 | 265 | 265 | 265 |
| | Storage elastic Modulus (MPa: 25° C.) | 1200 | 1600 | 1200 | 1200 | 1200 |
| Total film thickness (μm) | | 100 | 100 | 100 | 100 | 100 |
| Characteristics of wire | Thermal shock test | ⊙ | ⊙ | ⊙ | ⊙ | ⊙ |
| | Flexibility | ○ | ○ | ○ | ○ | ○ |
| | Abrasion resistance | ⊙ | ○ | ⊙ | ⊙ | ⊙ |

| | | Comp ex. 1 | Comp ex. 2 | Comp ex. 3 | Comp ex. 4 | Comp ex. 5 | Comp ex. 6 |
|---|---|---|---|---|---|---|---|
| First layer | Thermoplastic resin | PPS | PA66 | Modified PEEK | Thermoplastic PI | PEEK | PEEK |
| | Film thickness (μm) | 50 | 33 | 33 | 33 | 33 | 33 |
| | Melting point (° C.) | 275 | 265 | 340 | 388 | 345 | 345 |
| | Storage elastic Modulus (MPa: 25° C.) | 1600 | 1200 | 3700 | 1880 | 3840 | 3840 |
| | Storage elastic modulus (MPa: 300° C.) | <10 | <10 | 144 | 18.9 | 187 | 187 |
| Second layer | Thermoplastic resin | PA66 | PPS | PPS | Modified PEEK | PBN | ETFE |
| | Film thickness (μm) | 50 | 34 | 33 | 33 | 33 | 33 |
| | Melting point (° C.) | 265 | 275 | 275 | 340 | 243 | 260 |
| | Storage elastic Modulus (MPa: 25° C.) | 1200 | 1600 | 1600 | 3700 | 1920 | 850 |
| Third layer | Thermoplastic resin | | PEEK | PEEK | PPS | PBN | ETFE |
| | Film thickness (μm) | | 34 | 34 | 34 | 34 | 34 |
| | Melting point (° C.) | | 345 | 345 | 275 | 243 | 260 |
| | Storage elastic Modulus (MPa: 25° C.) | | 3840 | 3840 | 1600 | 1920 | 850 |
| Total film thickness (μm) | | 100 | 100 | 100 | 100 | 100 | 100 |
| Characteristics of wire | Thermal shock test | X | X | ⊙ | ⊙ | ⊙ | ⊙ |
| | Flexibility | ○ | X | X | X | X | ○ |
| | Abrasion resistance | ⊙ | ○ | ○ | ○ | ○ | X |

"Ex" stands for Example.
"Comp ex" stands for Comparative Example.

As shown in Table 1, the insulated wires of Examples 1 to 10 in which the thermoplastic resins that form the innermost insulating layer and the outer insulating layer satisfy the conditions of the present invention, in any case of two-layer insulating layer and three-layer insulating layer, passed the standards of any of the electric heat resistance test, the flexibility test after heating and the reciprocating abrasion test. By this, according to Examples 1 to 10, it was found that the following insulated wires can be produced: the insulated wires which satisfy requirement for improvement in heat resistance as well as combine requisite characteristics such as the thermal shock resistance, the flexibility before and after heating, the abrasion resistance and the like, each of which is required for a coil use.

Particularly, in the case where a polyamide resin was used in the outermost insulating layer, a result showing more excellent abrasion resistance was obtained. It was therefore found that requisite characteristics such as the flexibility before and after heating, the abrasion resistance and the like are obtained at the highest level by the configuration in which a PEEK resin or a modified PEEK resin was used in the innermost layer and a polyamide resin was used in the outermost layer, as shown in Examples 3, 5, 6, 8 and 10.

Further, the flexibility before and after heating was much more improved in the insulated wires having a three-layer insulating layer of Examples 3 to 10 when compared to the insulated wires having a two-layer insulating layer of Examples 1 and 2, because a difference in storage elastic modulus between each of the insulating layers became smaller, and if desired, innermost layer 12 which has a high storage elastic modulus can be thinly formed. Therefore, for the purpose of further improvement in the flexibility of the insulated wire, the multilayer insulating layer is preferably configured with a three-layer structure.

As seen above, the insulated wire of the present invention has all the requisite characteristics, and therefore electric or electronic equipment provided with the insulated wire of the present invention exerts high reliability such that insulation properties are retained even under severe processing conditions and usage environments.

In contrast, the insulated wires of Comparative Examples 1 and 2 were inferior in the thermal shock test, namely in terms of electric heat resistance, because the innermost insulating layer thereof was not formed of a resin having a sufficient heat resistance. In addition, in the insulated wire of Comparative Example 2, film float was observed in the flexibility test and an interlayer adhesion force was low, because the outermost insulating layer thereof was formed of a thermoplastic resin having a larger storage elastic modulus than the innermost insulating layer thereof.

As the outermost insulating layer of the insulated wire of Comparative Example 3 was formed of a thermoplastic resin having a larger storage elastic modulus than the interlayer insulating layer thereof, and further the interlayer insulating layer of the insulated wire of Comparative Example 4 was formed of a thermoplastic resin having a larger storage elastic modulus than the innermost insulating layer thereof, respective interlayer adhesion forces were low as in the case of Comparative Example 2. In addition, in consequence of occurrence of the film float, abrasion resistance was inferior to the results of Examples 1, 5 and the like, despite the use of a thermoplastic resin having a large storage elastic modulus in the outermost insulating layer.

The insulated wire of Comparative Example 5 was inferior in the flexibility after heating because both the interlayer insulating layer and the outermost insulating layer thereof were formed of a thermoplastic resin having a melting point of 260° C. or lower whereby the film was melted by heating.

The insulated wire of Comparative Example 6 was inferior in the abrasion resistance because the outermost insulating layer thereof was formed of a thermoplastic resin having a storage elastic modulus (25° C.) of less than 1,000 MPa.

Having described our invention as related to the present embodiments, it is our intention that the invention not be limited by any of the details of the description, unless otherwise specified, but rather be construed broadly within its spirit and scope as set out in the accompanying claims.

REFERENCE SIGNS LIST

1 Ferrite core
2: Bobbin
3: Insulating barrier
4: Primary winding
4*a*: Conductor
4*b*, 4*c*, 4*d*: Insulating layers
5: Insulating tape
6: Secondary winding
6*a*: Conductor
6*b*, 6*c*, 6*d*: Insulating layers
10, 20: Insulated wire
11, 21: Conductor
12, 22: Innermost insulating layer
13, 24: Outermost insulating layer
23: Interlayer insulating layer

The invention claimed is:

1. An insulated wire comprising:

a conductor; and a multilayer insulating layer composed of three insulating layers coating the conductor, the three insulating layers consisting of an innermost insulating layer and two outer insulating layers, wherein the innermost insulating layer of the multilayer insulating layer is an insulating layer formed of a crystalline thermoplastic resin having a storage elastic modulus of 10 MPa or more at 300° C, wherein the outer insulating layers other than the innermost insulating layer include an insulating layer formed of a crystalline thermoplastic resin having a melting point of 260° C. or higher and a storage elastic modulus of 1,000 MPa or more at 25° C, and wherein each set of adjacent insulating layers has a relationship to each other such that the storage elastic modulus at 25° C. of the thermoplastic resin in the insulating layer positioned at the outer side is smaller than the storage elastic modulus at 25° C. of the thermoplastic resin in the insulating layer positioned at the inner side.

2. The insulated wire according to claim 1, wherein the crystalline thermoplastic resin for forming the insulating layer of the innermost insulating layer is at least one selected from the group consisting of a polyetheretherketone resin, a modified polyetheretherketone resin, and a thermoplastic polyimide resin.

3. The insulated wire according to claim 1, wherein at least one of the outer insulating layers of the multilayer insulating layer is an insulating layer formed of a polyamide resin.

4. The insulated wire according claim 1, wherein the crystalline thermoplastic resin for forming the insulating layer of the innermost insulating layer is a polyetheretherketone resin or a modified polyetheretherketone resin, and at least one of the outer insulating layers is an insulating layer formed of a polyamide 6,6.

5. Electric or electronic equipment formed by using the multilayer insulated wire according to claim 1 as a winding wire and/or a lead wire of a transformer that is incorporated into the electric or electronic equipment.

6. An insulated wire comprising:

a conductor; and a multilayer insulating layer comprising three or more insulating layers coating the conductor, wherein the three or more insulating layers comprise an innermost insulating layer and two outer insulating layers, wherein the innermost insulating layer of the multilayer insulating layer is an insulating layer comprising a crystalline thermoplastic resin having a storage elastic modulus of 10 MPa or more at 300° C, wherein the outer insulating layers other than the innermost insulating layer include an insulating layer comprising a crystalline thermoplastic resin having a melting point of 260° C. or higher and a storage elastic modulus of 1,000 MPa or more at 25° C, and wherein each set of adjacent insulating layers has a relationship to each other such that the storage elastic modulus at 25° C. of the thermoplastic resin in the insulating layer positioned at the outer side is smaller than the storage elastic modulus at 25° C. of the thermoplastic resin in the insulating layer positioned at the inner side.

7. An insulated wire comprising:

a conductor; and a multilayer insulating layer composed of three insulating layers, the three insulating layers consisting of an innermost insulating layer coating the conductor, an interlayer insulating layer coating the innermost insulating layer, and an outermost insulating layer coating the interlayer insulating layer, wherein the innermost insulating layer of the multilayer insulating layer is an insulating layer formed of a crystalline thermoplastic resin having a storage elastic modulus of 10 MPa or more at 300° C, wherein the interlayer insulating layer and the outermost insulating layer include an insulating layer formed of a crystalline thermoplastic resin having a melting point of 260° C. or higher and a storage elastic modulus of 1,000 MPa or more at 25° C, wherein the storage elastic modulus at 25° C. of the thermoplastic resin in the outermost insulating layer is smaller than the storage elastic modulus at 25° C. of the thermoplastic resin in the interlayer insulating layer, and wherein the storage elastic modulus at 25° C. of the the imoplastic resin in the interlayer insulating layer is smaller than the storage elastic modulus at 25° C. of the thermoplastic resin in the innermost insulating layer.

* * * * *